US007235020B1

(12) United States Patent
Christensen

(10) Patent No.: US 7,235,020 B1
(45) Date of Patent: Jun. 26, 2007

(54) GOLD CLUB SPEED INDICATOR

(76) Inventor: Robert Christensen, 1300 A1A S. Ocean Crest #502, Jupiter, FL (US) 33477

( * ) Notice: Subject to any disclaimer, the term of this patent is extended or adjusted under 35 U.S.C. 154(b) by 0 days.

(21) Appl. No.: 11/673,244

(22) Filed: Feb. 9, 2007

(51) Int. Cl.
*A63B 69/36* (2006.01)

(52) U.S. Cl. ..... 473/226; 473/233

(58) Field of Classification Search ..... 473/219–256, 473/516, 524, 553, 457, 459, 451; 73/65.03, 73/488, 491, 492, 493; 434/252
See application file for complete search history.

(56) References Cited

U.S. PATENT DOCUMENTS

| | | | | |
|---|---|---|---|---|
| 2,543,722 | A * | 2/1951 | Hetzel | 473/233 |
| 3,561,272 | A * | 2/1971 | Davis | 473/233 |
| 3,733,077 | A * | 5/1973 | Fennell | 473/233 |
| 4,267,793 | A * | 5/1981 | Lane et al. | 116/324 |
| 4,270,753 | A * | 6/1981 | Maroth et al. | 473/233 |
| 4,684,133 | A * | 8/1987 | Maroth | 473/233 |
| 5,656,772 | A * | 8/1997 | Markel | 73/146.8 |
| 5,779,555 | A * | 7/1998 | Nomura et al. | 473/233 |
| 6,231,453 | B1 * | 5/2001 | Jebe | 473/233 |
| 7,144,329 | B2 * | 12/2006 | Tamura | 473/223 |
| 2003/0017882 | A1 * | 1/2003 | Hossack | 473/222 |

* cited by examiner

*Primary Examiner*—Sebastiano Passaniti
(74) *Attorney, Agent, or Firm*—McHale & Slavin P.A.

(57) ABSTRACT

An indicator mechanism or gauge is located in a golf club and provides an indication that the "sweet spot" on a golf club head has been hit and the speed of the club head. The indicator mechanism includes a sensor mounted on the head of a golf club and an indicator positioned on top of the shaft of the club. The sensor detects the impact of the golf ball and hydraulically transmits this information to the indicator mechanism. A visual indicator protrudes from the top of the golf club shaft and provides an indication of the speed of the golf club.

11 Claims, 5 Drawing Sheets

GOLD CLUB SPEED INDICATOR

FIELD OF THE INVENTION

The present invention relates to golf equipment and more particularly, to a golf club having a sensor in the head and an associated display for indicating the forces applied to a golf ball.

BACKGROUND OF THE INVENTION

Millions of people enjoy the game of golf. One of the key elements of the game is to determine how far the ball must be hit. There are circumstances during the game when the ball should travel as far as possible and circumstances when the ball only has to travel a limited distance. The factors which determine the distance that a golf ball will travel include the initial velocity, launch angle, spin rate and spin axis of the ball. The initial velocity has the greatest affect on the distance traveled. There are two general methods for analyzing a golf club during a swing, visual analysis and quantitative analysis.

The visual analysis is typically done by a golf instructor capable of discerning the golf swing variables and suggesting corrections to the golfer to improve their swing. Another method of visual analysis is performed utilizing cameras to record the golfer's swing and then playing back the recordings and comparing them to a model swing. Using various camera angles and slow motion, the actual swing can be analyzed and changes determined for future swings.

Quantitative analysis, on the other hand, employs sensors to measure the various mechanical and physical properties of the golf club during the swing. Sensors such as strain gauges or accelerometers are typically attached to the golf club or head. Data collected from these sensors are then transferred to a display viewable by the golfer. A significant drawback associated with a number of these gauges is that the golf clubs must be provided with wires to send the data to the displays. These wires can be cumbersome and interfere with a golfer's swing such that an accurate measurement of the swing cannot be made.

DESCRIPTION OF THE PRIOR ART

U.S. Pat. No. 4,991,850 discloses a golf swing evaluation system which includes a golf club containing a sensor and a display for indicating the force and location of the golf club head against a golf ball. Piezoelectric sensors measure the acceleration of the golf club and the impact area in which the club struck the golf ball. This information is transmitted via wires to a display device where the golfer can view the results. The drawback with this system is that the wires from the golf club to the display interfere with the golfer's swing.

U.S. Pat. No. 5,303,925 discloses a golf swing gauge which can be attached to the shaft of a golf club. The gauge measures the centrifugal force at the gauge during a golf swing. The gauge utilizes a needle to indicate the force at which the golf club has been swung. The gauge is calibrated by the use of weights that can be added or removed. The drawbacks with this system is that the force of the golf club is not measured at the head of the club where the ball is struck and there is no standard to which the gauge can be calibrated to obtain a true measure of the golfer's swing.

U.S. Pat. No. 6,705,952 discloses a golf club provided with an internal gauge that measures the force of a golf swing. The gauge comprises a marker barrel, an attached distance rod, and a main spring. When the golf club is swung, centrifugal force causes the marker barrel and attached distance rod to move a particular distance within the main spring. The tension of the main spring regulates this distance. The position of the marker barrel can be seen through openings in the shaft of the golf club. A release mechanism allows the marker to be returned to its initial position after the force of a swing has been determined. The distance the gauge moves along the golf club is an indication of the amount of force of the golfer's swing. Indicia on the golf club shaft at each opening indicate how far a golf ball would have traveled when struck with that force. Once again the force of the club is not measured at the head where the ball is struck by the club and therefore an accurate reading is not obtained.

U.S. Pat. Nos. 3,561,272; 4,270,753; 4,363,488; 4,684,133; and 4,967,596 disclose various force gauges which are attached to the shaft of a golf club and by measuring centrifugal force give an indication of the force of the swing. Since these gauges are not located on the head of the golf club, they do not give the user an accurate reading.

SUMMARY OF THE INVENTION

The present invention is directed to an indicator mechanism or gauge located in a golf club to measure if the "sweet spot" on a golf club head has been hit and the speed of the club head. The indicator mechanism includes a sensor mounted on the head of a golf club and an indicator positioned on top of the shaft of the club. The indicator provides an indication of the speed of the head of the club when the ball has been struck. The indicator mechanism is hydraulically operated. This hydraulic system provides dependable and repeatable results. There are no springs which can stretch and get out of adjustment. The hydraulic oil is incompressible and therefore the measuring gauge does not need to be calibrated. Also, there are no electronic devices which can become damaged through use and abuse.

Accordingly, it is an objective of the instant invention to provide an indicator which will inform the user of the speed of the head of a golf club.

It is a further objective of the instant invention to provide the user with an indication that the "sweet spot" of the golf club head has been struck.

It is yet another objective of the instant invention to provide a gauge located on the shaft of a golf club which accurately measures the speed of the head of the club.

It is a still further objective of the invention to provide an indicator on the golf club which provides the user with an indication in MPH of the speed of the club head.

It is yet a further objective of the invention to provide a gauge to measure the speed of a club head which does not require any adjustment or calibration on the part of the user.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
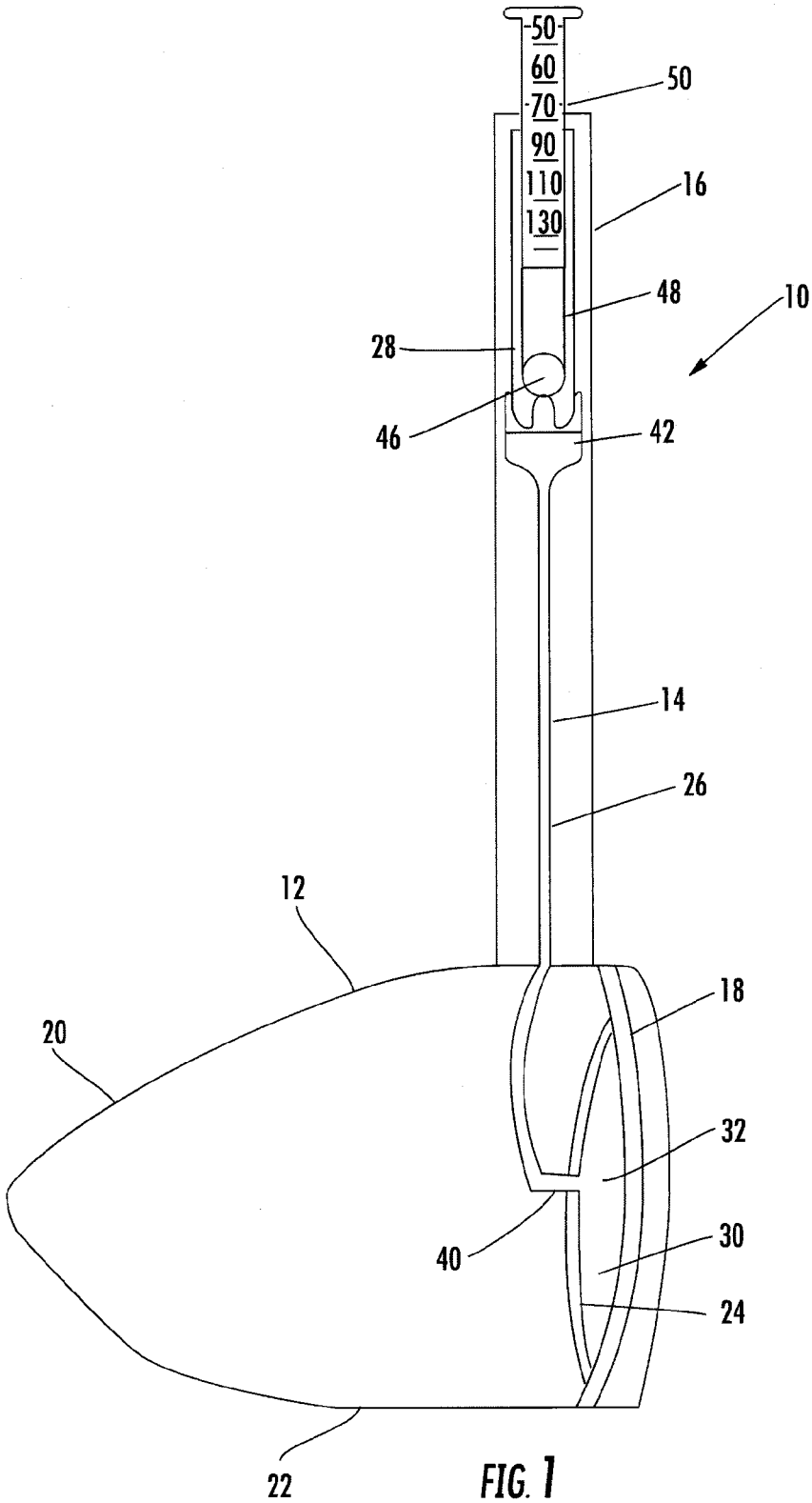
FIG. 1 is a fragmentary side view of a golf club incorporating the present invention.

Referring now in detail to the drawings, in which like numerals indicate like elements throughout the several views, FIG. 1 illustrates a golf club speed or velocity indicator incorporated into a conventional golf club. The speed indicator has three basic elements. A sensor 24, a transfer mechanism 26 and an indicating mechanism 28. The golf club 10 of the present invention has a club head 12 at one end of a shaft 14 and a grip 16 at the other end thereof. The golf club head 12 has a face 18, a back 20 and a sole 22. The grip 16 and shaft 14 are substantially hollow and tapered toward the club head 12.

The present invention can be incorporated into a conventional golf club without affecting the overall performance of the club. As illustrated in FIG. 1, the face 18 of the club head is provided with a sensor 24. The sensor 24 is located on the opposite side of the face 18 that strikes the golf ball and within the body of the club head 12. The sensor 24 is positioned on the rear portion of the face opposite the "sweet spot". This is the quarter size area in the middle of the face of the club head. When the ball is struck with this portion of the club face, it will travel the farther and straighter that when struck with any other portion of the club face. As a result every golfer tries to hit the ball with this portion of the face of the club. It is normally difficult to determine if the golf ball has been struck with the "sweet spot" on the face of the club head. The sensor detects the maximum impact of the golf club head and the ball only when the ball impacts the "sweet spot" on the club head. This impact or force is then transmitted to the indicator in the grip of the club handle. If the golf ball is not struck in the "sweet spot" of the club head a relatively low force will be detected by the sensor and consequently a relatively low speed will be indicated on the indicator.

The sensor 24 is a disk shaped fluid container 30 attached to the rear side of the face of the head of a golf club. The disk is preferably made of titanium to withstand the large forces generated by the golf balls impacting the face of the club head and to not significantly add weight to the club head. Of course other material could be utilized as long as they produced the desired results. The reservoir is filled with hydraulic oil 32. The oil is a preferred fluid since it is incompressible and will not corrode the elements of the speed indicator. Silicone oil is preferable because it is not hygroscopic. The sensor 24 is secured to the rear portion of the face of the club head preferably by welding, but it can be attached by any suitable means. The oil is introduced into the sensor through a fill tube 34 located in the club head, FIG. 3. Once the sensor and speed indicator are completely filled with oil, the end of fill tube is closed with a threaded plug or screw 32 to contain the oil therein.

Figure 2:
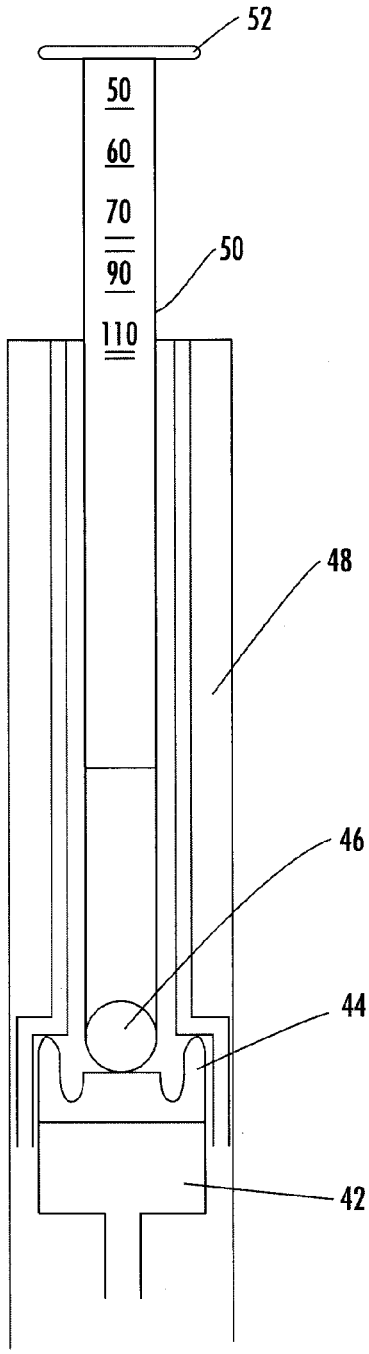
FIG. 2 is a fragmentary view of the top portion of a shaft of a golf club including the indicator of the present invention.
Figure 3:
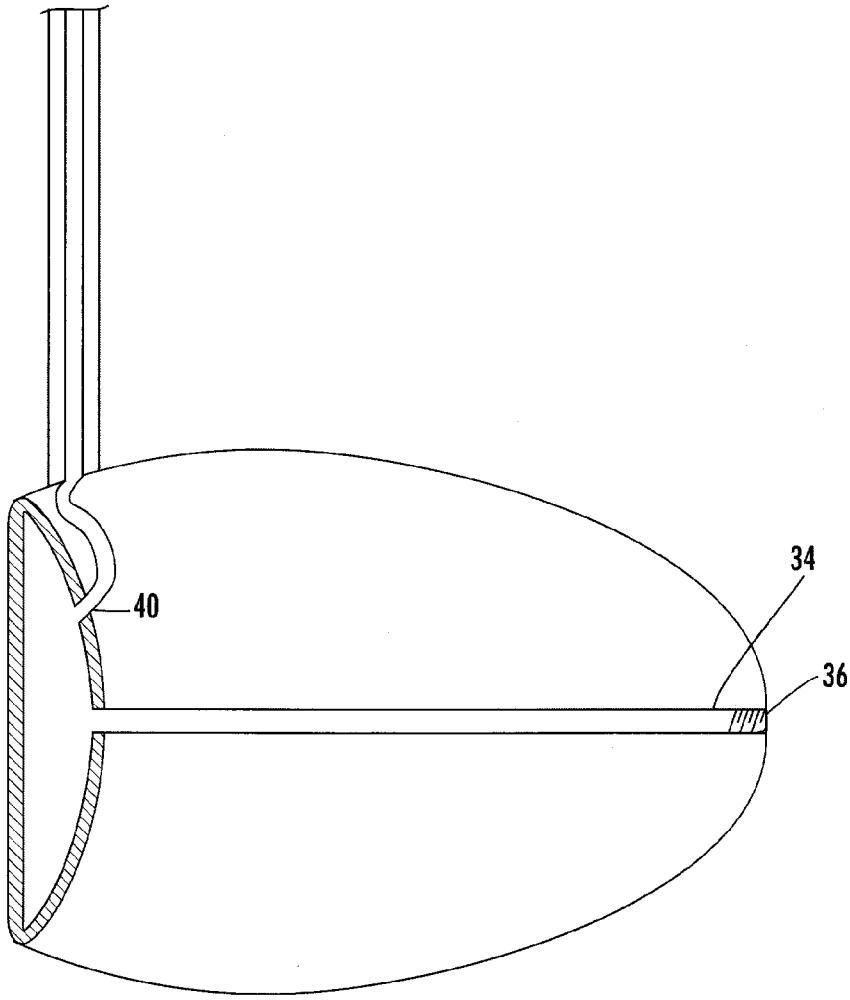
FIG. 3 is a side planar view of a golf club incorporating the present invention.
Figure 4:
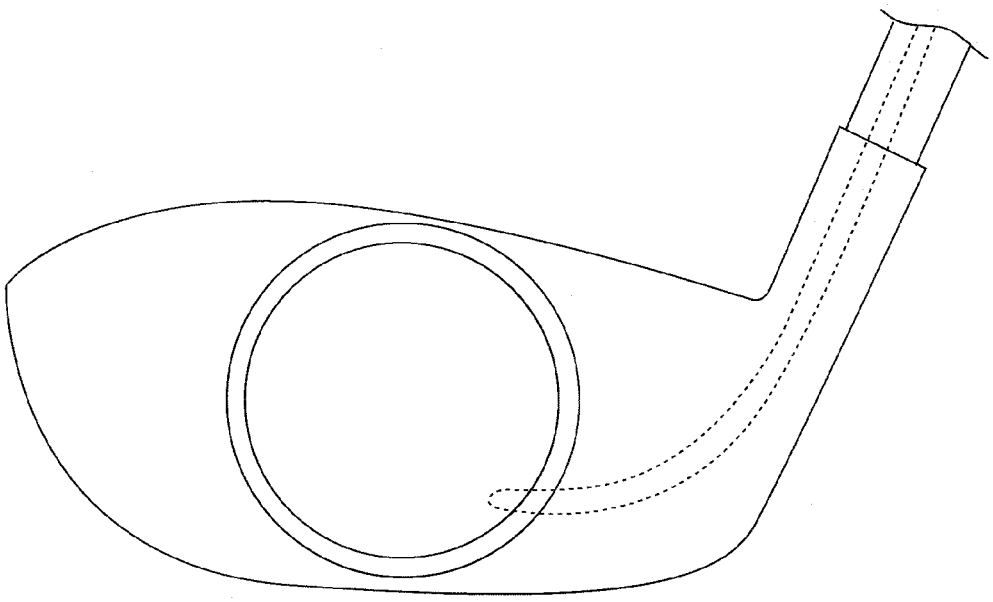
FIG. 4 is a front planar view of the club head of a golf club.

A transfer mechanism 26 is connected at one end thereof to sensor 24. The transfer mechanism is preferably a tube 38. The tube is fluidly connected to sensor 24 at point 40, as shown in FIGS. 1 and 3. In a preferred embodiment the tube is also made from titanium for light weight and lack of corrosion. The tube 38 extends from the sensor 24 through the club head and up through the hozel. It continues up through the shaft and connects to the indicating mechanism at fluid reservoir 42 (FIGS. 1 and 2). The diameter of the tube is selected such that the force generated by the impact of the golf ball on the sensor will instantaneously be transmitted to the fluid reservoir 42. In a preferred, but not limiting embodiment the tubing has an internal diameter of ⅛ inch. The tubing can also be formed from a plurality of tubes made from different materials.

The indicator mechanism comprises a number of different elements. A fluid reservoir 42 is fluidly connected to one end of the transfer mechanism tube 38 in an upper portion of the shaft 14. A bellows 44 is attached to an upper end of the reservoir. The bellows 44 is in fluid communication with the fluid in the reservoir such that any increase in the amount of fluid within the reservoir will extend the bellows. The bellows is preferably formed from a flexible material, but other materials can also be used. The impact of a golf ball on the sensor 24 pushes an amount of fluid out of the sensor, through the transfer mechanism and into the reservoir thereby increasing the amount of fluid in the reservoir.

A ball 46 is positioned directly on bellows 44 in a first embodiment of the indicator mechanism, illustrated in FIGS. 1 and 2. A sleeve 48 is positioned adjacent the bellows and extends upwardly toward the top of the grip 16. The ball normally rests on the bellows in a lowermost portion of the sleeve 48. An indicator 50 is positioned in an upper portion of the sleeve and extends out of the top of the sleeve. The indicator 50 has indicia thereon representative of the speed of the club head. The ball 46 is projected upwardly by the bellows and strikes the bottom of the indicator 48 thereby activating it. The ball 46 therefore is an activator for the indicator 50. The greater the force of the ball striking the indicator, the higher the indicator is moved. As the indicator is moved upwardly, a larger portion of the indicator extends out of the top of the grip. The indicia on the indicator 50 indicate greater club head speeds the farther the indicator extends out from the top of the grip. Prior to any measurements, the indicator 50 is pushed down into the grip until the top 52 of the indicator 50 is flush with the top of the grip. To obtain an indication of the speed of the club head, a person using the present invention would observe the indicia on the indictor at the point at which it exits the top of the grip after the golf club has been swung. In the example illustrated in FIG. 2, the speed of the club head is 110 MPH.

The speed of the club head at the time of impact with the golf ball determines the force detected by the sensor 24. The faster the speed of the club head, the larger the force detected by the sensor. This force is transmitted from the sensor through the transfer mechanism and into the reservoir 42 of the indication mechanism. The movement of the bellows 44 is dependent on the size of the force received from the sensor. The larger the force, the greater the movement of the bellows. The amount of movement of the bellows is translated into the amount of movement of the ball 46. The ball actuates the indicator 48 by striking the bottom thereof. The greater the movement of the ball, the higher the indicator 48 is moved out of the top of the shaft of the club. The scale on the indicator is calibrated in such a way that the higher the indicator protrudes from the top of the club the greater the indication of the speed of the club head.

Figure 5:
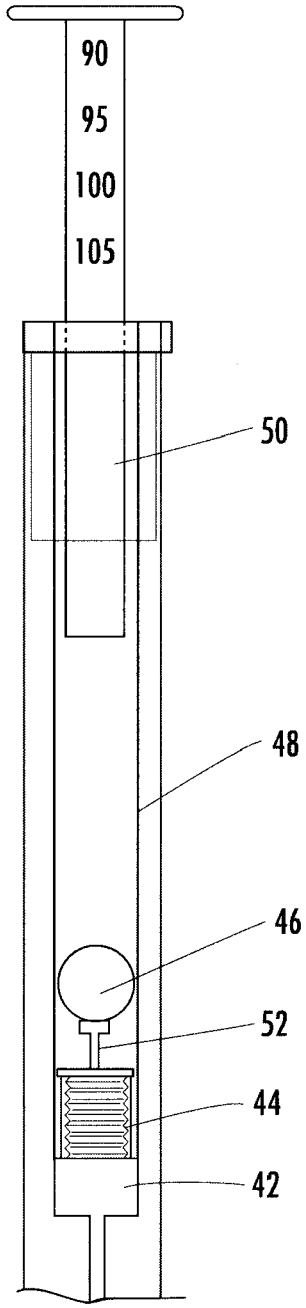
FIG. 5 is a fragmentary view of the top portion of a shaft of a golf club including a second embodiment of the indicator.

A second embodiment of the indicator mechanism is illustrated in FIG. 5. The bellows has a different shape from the first embodiment and includes a threaded element 52 which supports the ball 46 when it is at rest and functions as an air bleeder when the speed indicating elements are filled with oil. The bellows in this embodiment can be formed from a metal such as stainless steel.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A golf club, for measuring the force of a golf swing and the speed at which a golf ball would travel after being hit by the golf club, comprising:

a golf club including a proximal end having a handle portion, a distal end having a club head and an elongated shaft extending between said handle portion and said club head;

a sensor positioned in said club head and being constructed and arranged to measure the speed of said club head;

a non electronic speed indication mechanism located in said handle portion of said golf club, said non electronic speed indication mechanism providing an indication of the speed of said club head during a golf swing;

said non electronic speed indication mechanism responsive to a force generated by said sensor; and said non electronic speed indication mechanism including a visual indicator, indicating the speed of said club head during a golf swing.

2. The golf club according to claim 1 wherein said golf club further includes a transfer mechanism for transferring said force generated by said sensor to said non electronic speed indicating mechanism;

said non electronic speed indicator mechanism further includes a fluid reservoir connected to said transfer mechanism, a bellows connected to said fluid reservoir and an actuator, operated by said bellows, constructed and arranged for actuating said visual indicator.

3. The golf club according to claim 2, wherein said visual indicator comprises a linearly movable element including a scale thereon;

said actuator moving said linearly movable element in response to said force generated by said sensor;

said linearly movable element indicating the speed of said club head.

4. The golf club according to claim 1, wherein said sensor is positioned in said golf club head and oriented to sense an impact on the face of said golf club in an area which produces a maximum velocity of a golf ball when struck by said golf club;

said sensor comprising a fluid container attached to a rear side of the face of said golf club.

5. The golf club according to claim 3, wherein said sensor, said transfer mechanism and said reservoir are fluidly connected to each other.

6. The golf club according to claim 5, wherein said sensor, said transfer mechanism and said fluid reservoir contain hydraulic fluid, whereby when said sensor strikes a golf ball the force of the impact is transferred from said sensor through said transfer mechanism and into said fluid reservoir by said hydraulic fluid.

7. The golf club according to claim 5, wherein said transfer mechanism comprises a tube connected to said sensor at one end and said fluid reservoir at the other end.

8. The golf club according to claim 3, wherein said non electronic speed indicator mechanism further includes a housing;

said fluid reservoir positioned at one end of said housing;

said visual indicator positioned at an opposite end of said housing; and said actuator positioned in between said fluid reservoir and said visual indicator.

9. The golf club according to claim 8, wherein said housing is positioned at said proximal end of said golf club;

said visual indicator is constructed and arranged to proportionally extend from said housing and said proximal end of said golf club based on the speed of the golf club head.

10. The golf club according to claim 3, wherein said actuator comprises a ball.

11. The golf club according to claim 1, wherein said non electronic speed indication mechanism indicates the speed of said club head during a golf swing at the moment of impact of a golf ball and the area of the face of the golf club head which produces a maximum velocity of the golf ball.

* * * * *